US006758427B2

(12) United States Patent
Kronenberger

(10) Patent No.: US 6,758,427 B2
(45) Date of Patent: Jul. 6, 2004

(54) BOBBIN ASSEMBLY WITH BACKLASH PREVENTING STRUCTURE

(76) Inventor: Ronald Kronenberger, 320 Portwine Rd., Riverwoods, IL (US) 60089

( * ) Notice: Subject to any disclaimer, the term of this patent is extended or adjusted under 35 U.S.C. 154(b) by 0 days.

(21) Appl. No.: 09/794,702

(22) Filed: Feb. 27, 2001

(65) Prior Publication Data

US 2002/0117568 A1 Aug. 29, 2002

(51) Int. Cl.[7] ..... B65H 49/00; B65H 54/553
(52) U.S. Cl. ..... 242/129.8
(58) Field of Search ..... 242/118.7, 128, 242/129.8, 138, 156, 598.6, 423.1, 610.6, 611, 611.1, 423, 423.2, 129.7

(56) References Cited

U.S. PATENT DOCUMENTS 335,692 A * 2/1886 Fries ..... 242/118.7 X
1,354,434 A * 9/1920 Fassoulis ..... 242/136
1,640,760 A * 8/1927 Emery ..... 242/156
2,158,659 A * 5/1939 Holman ..... 242/423
2,333,340 A * 11/1943 Rickenbacher ..... 242/118.7 X
2,555,658 A 6/1951 Ritter
3,464,647 A * 9/1969 Jacobi ..... 242/129
3,788,573 A * 1/1974 Thomson et al. ..... 242/423.1
3,861,617 A * 1/1975 Davidson et al. ..... 242/156 X
3,870,242 A * 3/1975 Schussel ..... 242/129.8 X
3,995,786 A * 12/1976 Deniega ..... 242/128 X
4,157,691 A * 6/1979 Cerliani ..... 112/229
4,171,783 A * 10/1979 Waltemath ..... 242/128
4,184,647 A * 1/1980 Rourke ..... 242/423
4,184,652 A * 1/1980 Rovin ..... 242/118.2
4,217,839 A * 8/1980 Barat ..... 112/229
4,434,734 A * 3/1984 Russell ..... 112/181
4,494,710 A * 1/1985 Harris et al. ..... 242/156

* cited by examiner

*Primary Examiner*—Emmanuel Marcelo
(74) *Attorney, Agent, or Firm*—Wood, Phillips, Katz, Clark & Mortimer

(57) ABSTRACT

The combination of a bobbin assembly and a support for the bobbin assembly. The bobbin assembly has a core around which a supply of thread can be wrapped. The core has a rotational axis. The bobbin assembly further has a first flange with first and second oppositely facing surfaces. The first surface bounds a storage space for thread wrapped around the core. The first flange has at least one projection from the second surface. The support has a third surface facing the second surface and bearing against the at least one projection for limiting movement of the spool in a direction substantially parallel to the rotational axis with the bobbin assembly operatively connected to the support.

26 Claims, 3 Drawing Sheets

BOBBIN ASSEMBLY WITH BACKLASH PREVENTING STRUCTURE

BACKGROUND OF THE INVENTION

1. Field of the Invention

This invention relates to bobbin assemblies for supplies of thread as used on different sewing machines and, more particularly, to a bobbin assembly having structure which cooperates with a support for the bobbin assembly to prevent backlash of thread due to overrunning.

2. Background Art

Bobbins are used for thread supplies on a wide range of sewing equipment. Typically, the bobbin has a core with a rotational axis and axially spaced flanges which bound a storage space for thread wrapped around the core. The bobbin is mounted on a support for rotation around the core axis. By rotating the bobbin, thread wrapped around the core is controllably paid out.

Ideally, the bobbin is guidingly rotated during operation without any significant resistance as might cause uneven line distribution or, in a worse case, jamming of the bobbin. While smooth rotation of the bobbin is desirable during sewing operations, the unimpeded rotation of the bobbin potentially causes thread backlash. Ideally, as the machinery is stopped, the bobbin rotation simultaneously ceases. However, due to the free rotation of the bobbin, the momentum of the rotating bobbin causes it to continue to rotate which could produce a backlash in the thread. This may require that the machinery be shut down to allow the backlash to be eliminated. Severely backlashed thread may have to be cut. Potentially, there is a significant loss of operating time, as well as the inconvenience of having to manually remedy the backlash situation. Severe backlashing may require replacement of the bobbin with a bobbin having a new supply of thread. Consequently, significant amounts of thread may be wasted.

Potentially of greater significance is the fact that a slackened thread resulting from overrunning of the bobbin may cause at least temporary defective stitching after the equipment is re-started. This may lead to defective product that may have to either be restitched or destroyed.

To address this problem, it is known to install disk-like spring elements on a case which confines the bobbin into its operative position. These springs have deflectable arms which produce a frictional bias force on the bobbin. This force is preferably controlled so that it does not significantly impede rotation of the bobbin during a sewing operation yet produces enough resistance that the bobbin will not continue to rotate once the equipment is stopped as might cause thread backlash.

SUMMARY OF THE INVENTION

In one form, the invention is directed to the combination of a bobbin assembly and a support for the bobbin assembly. The bobbin assembly has a core around which a supply of thread can be wrapped. The core has a rotational axis. The bobbin assembly further has a first flange with first and second oppositely facing surfaces. The first surface bounds a storage space for thread wrapped around the core. The first flange has at least one projection from the second surface. The support has a third surface facing the second surface and bearing against the at least one projection for limiting movement of the spool in a direction substantially parallel to the rotational axis with the bobbin assembly operatively connected to the support.

The combination may include a supply of thread wrapped around the core. In one form, the first and second surfaces have substantially the same area and the at least one projection occupies an area that is less than the area of the second surface.

The at least one projection may be formed as one piece with the first flange or separately formed and fixedly attached to the first flange.

In one form, the bobbin assembly has a second flange that is spaced along the rotational axis from the first flange so that the first and second flanges cooperatively bound the thread storage space.

In one form, there are a plurality of projections from the second surface which bear against the third surface of the bobbin assembly, with the bobbin assembly operatively connected to the support.

The at least one projection may be in the form of a ridge.

The projection may be defined by roughening the second surface.

The at least one projection may be a projecting post.

The at least one projection may be defined by an element embedded in the first flange.

The first flange and at least one projection may be made from the same material or different materials.

In one form, the at least one projection is repositionable relative to the first flange, as by bending.

The at least one projection may be made from a shape-retentive material that can be selectively formed and maintained in a plurality of different configurations.

The support may be a bobbin basket and/or a bobbin case.

The bobbin basket may include a post which projects into the core. The bobbin assembly moves around the post as the bobbin basket moves around the rotational axis.

The invention is also directed to a bobbin assembly as described above, for mounting to a support.

DETAILED DESCRIPTION OF THE DRAWINGS

Figure 1:
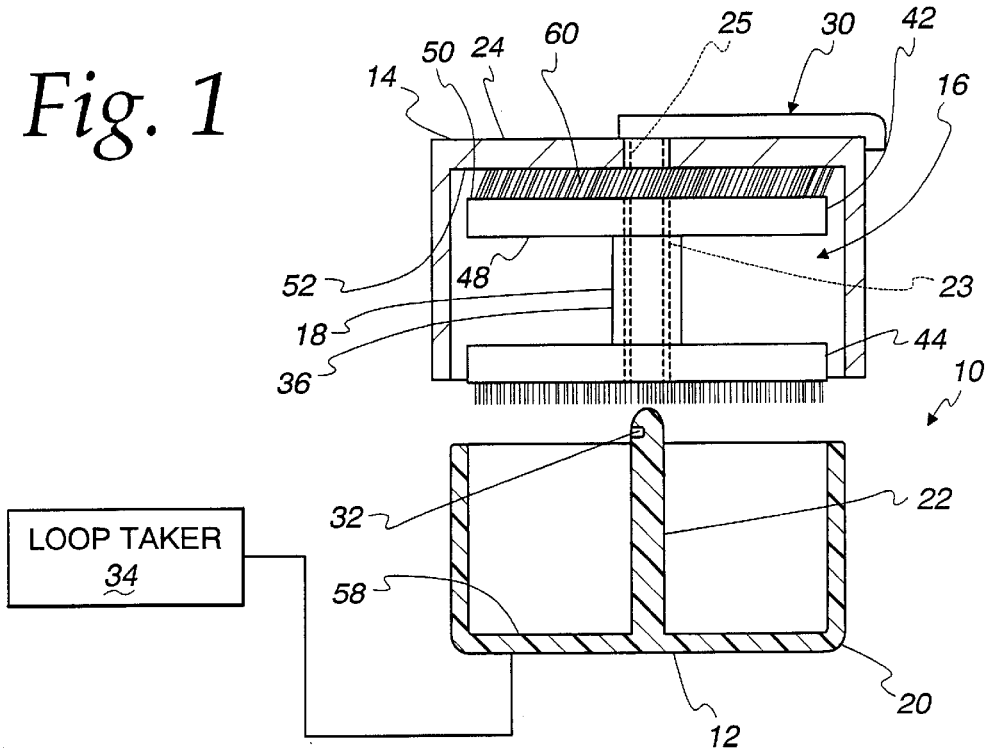
FIG. 1 is a partially schematic, exploded, partial cross-sectional view of a bobbin assembly with projections on spaced flanges thereon, according to the present invention, and with the bobbin assembly operatively connected to a bobbin basket, a bobbin case, and a loop taker.

In FIG. 1, a sewing machine assembly is shown at 10 and consists of a bobbin basket 12 and a cooperating bobbin case 14 which are matable to produce a compartment 16 for one form of bobbin assembly 18, according to the present invention. The bobbin basket 12 has a cup-shaped body 20 with a post 22 projecting upwardly therefrom for passage through a hollow sleeve 23 depending from a top wall 24 and a contiguous opening 25 through the top wall 24 of the cup-shaped bobbin case 14. The post 22 is directed through the sleeve 23 fully so as to be exposed at the top of the wall 24. A latch assembly 30 is operable to engage a notch 32 in the post 22 to prevent separation of the mated bobbin case 14 and bobbin basket 12, as with the bobbin assembly 18 operatively connected thereto and captive therebetween. A conventional loop taker 34 is operably associated with the joined bobbin basket 12 and bobbin case 14 and is useable in conventional manner, as well known to those skilled in this art.

Figure 2:
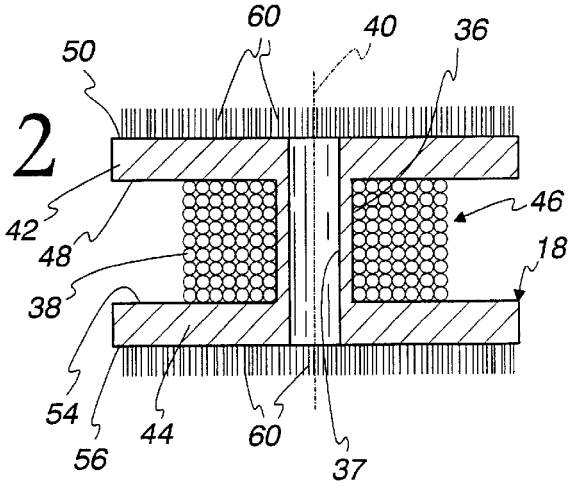
FIG. 2 is a side elevation view of the bobbin assembly in FIG. 1 with a supply of thread wrapped therearound.

The bobbin assembly 18, as seen also in FIG. 2, consists of a cylindrical core 36 around which a supply of thread 38 is wrapped. The hollow sleeve 23 extends through a bore 37 in the core 36 50 that the bobbin assembly 18 is rotatable guidingly around the sleeve 23 about an axis 40 relative to the bobbin basket 12 and bobbin case 14.

The bobbin assembly 18 further consists of disk-shaped, first and second flanges 42, 44, at axial ends of the core 36 and cooperatively bounding a thread storage space 46.

The bobbin assembly construction may vary considerably in terms of its shape and composition. As one example, the entire bobbin assembly 18 can be molded or otherwise formed from one piece of plastic. Alternatively, the bobbin assembly 18 can be made from metal. As a still further alternative, the flanges 42, 44 can be made from a different material than the core 36. It is known, for example, to make the flanges 42, 44 from a paper-type material.

The bobbin basket 12 and bobbin case 14 cooperatively define a support for the bobbin assembly 18. The flange 42 has a first surface 48 that bounds the storage space 46, and an oppositely facing second surface 50. With the bobbin assembly 18 operatively connected as in FIG. 1, the first surface 48 faces a third surface 52 on the bobbin case/support 14.

The flange 44 has a surface 54 bounding the storage space 46 and an oppositely facing surface 56 which is in proximity to an oppositely facing surface 58 on the bobbin basket/support 12 with the bobbin assembly 18 operatively connected as in FIG. 1 and the bobbin basket 12 and bobbin case 14 joined to each other.

According to the invention, one or both of the surfaces 50, 56 has at least one projection 60 , and in this case a plurality of projections 60. The projections 60 shown are fiber-like projections 60 which are either integrally formed with the flanges 42, 44 or separately adhered thereto, as by an adhesive. The fiber-like projections 60 may be integrally formed in a molding operation or attached as part of a sheet, or individually, as by an adhesive. The fiber-like projections 60 may be made from plastic, metal, or virtually any other type of material having sufficient integrity to remain reasonably intact after use in this environment, as described below. The projections 60 might be made from metal, or other material that is embedded in the flanges 42, 44.

The projections 60 on the first flange 42 bear against the bobbin case surface 52, whereas the projections 60 on the flange 44 bear against the surface 58 on the bobbin basket 12, with the bobbin assembly 18 operatively connected as in FIG. 1 and the bobbin basket 12 and bobbin case 14 joined to each other. The projections 60 are dimensioned so that, while they bear against the surfaces 52, 58 as the bobbin assembly 18 is rotated around the axis 40 in operation, they do not significantly impede the rotation of the bobbin assembly 18 relative to the bobbin basket 12 and bobbin case 14. At the same time, the projections 60 produce enough resistance to prevent overrunning of the bobbin assembly 18, once the machinery is stopped and thread is no longer being drawn off of the bobbin assembly 18 as might otherwise produce backlash. The projections 60 can be made of a dimension to either be maintained in their straight configuration or bent partially towards the surface from which they project, as shown for the projections 60 acting against the bobbin case surface 52 in FIG. 1. The projections 60 could also be configured to be bent against the surface from which they project.

Figure 3:
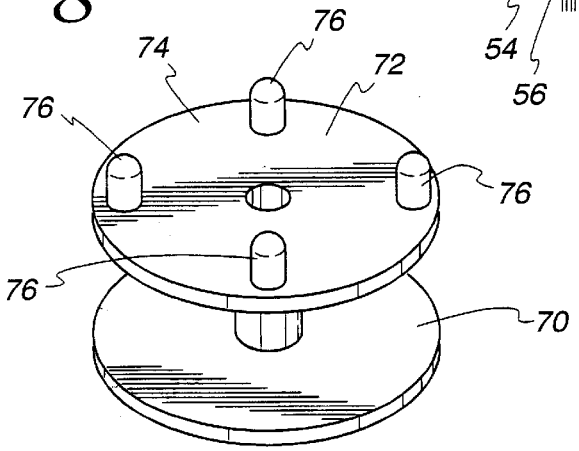
FIG. 3 is a perspective view of a bobbin assembly with an alternative form of projection on one flange thereof, according to the present invention.

In FIG. 3, a bobbin assembly 70 is shown with the same general construction as the bobbin assembly 18 and has a flange 72 with a surface 74 and a plurality of cantilevered, post-like projections 76 from the surface 74, at spaced locations, to bear against a facing support surface, such as those 52, 58, previously described. As in all embodiments described herein, the bobbin assembly 70 may be made from virtually any material, with the projections 76 likewise being made from any material that facilitates sliding movement against either of the support surfaces 52, 58 and which produces enough resistance to avoid overrunning. The projections 76 may be relatively rigid or somewhat flexible so as to be bendable during operation.

Figure 4:
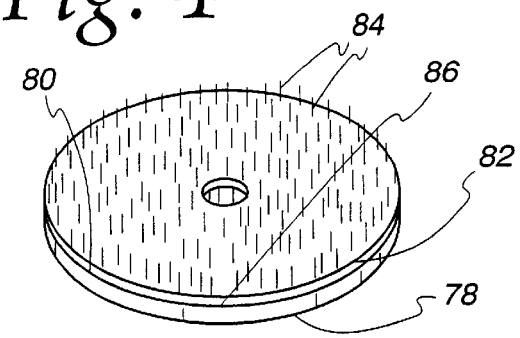
FIG. 4 is a perspective view of a flange on the inventive bobbin assembly with another form of projection thereon.
Figure 5:
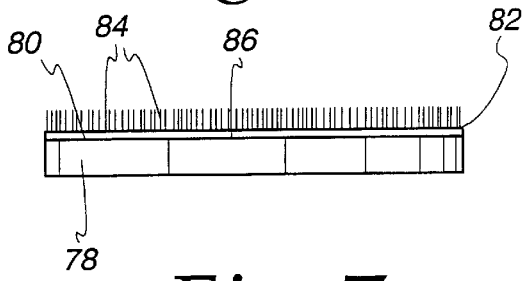
FIG. 5 is a side elevation view of the flange in FIG. 4.

In FIGS. 4 and 5, an alternative form of projection is shown on an exemplary flange 78 that may be useable on a bobbin basket to cooperative with a support surface. The flange 78 has a surface 80 which supports a layer 82 having projections 84 thereon. The layer 82 may be maintained on the flange 78 by an adhesive 86. The projections 84 may be rigid or in the form of fibers. As just one example, the layer 82 with the projections 84 thereon may be a component typically used in hook-and-loop type fasteners systems. That is, the projections 84 may be part of a hook-type element or loop-type element that is part of such a fastener system.

Figure 7:
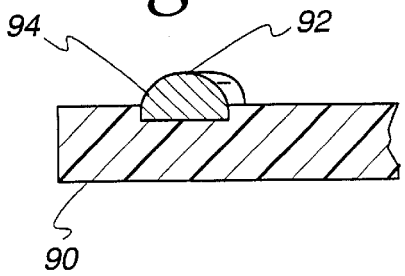
FIG. 7 is a cross-sectional view of the flange taken along line 7—7 of FIG. 6.
Figure 6:
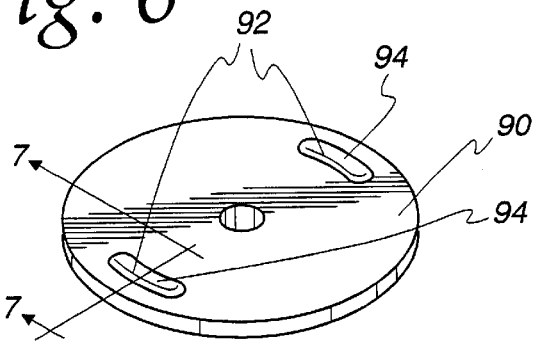
FIG. 6 is a view as in FIG. 4 of a still further form of projection which is embedded in the flange, according to the invention.

In FIGS. 6 and 7, a flange 90 is shown with ridge-like projections 92 that are embedded in the flange 90. As just one example, the material defining the flange 90 may be plastic, which is molded around each projection 92. Alternatively, the projections 92 may be frictionally held in place or held in place by an adhesive. The projections 92 shown have convex outer surfaces 94 which bear on a cooperating support surface. The number, shape and configuration of the projections 92 in FIGS. 6 and 7 may vary from that shown.

Figure 8:
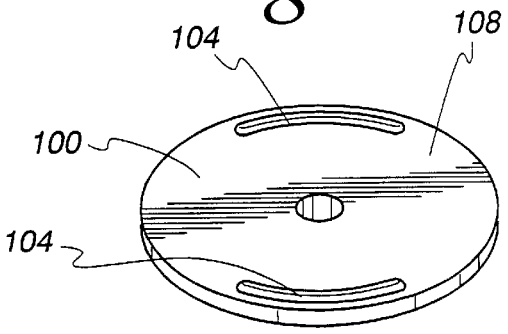
FIG. 8 is a view as in FIG. 4 of a further modified form of projection, according to the present invention.
Figure 9:
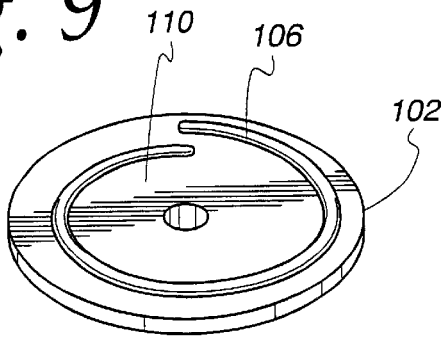
FIG. 9 is a view as in FIG. 8 of a further modified form of projection, according to the present invention.

In FIGS. 8 and 9, separate flanges 100, 102 are shown with integrally formed ridge-like projections 104, 106 from surfaces 108, 110 on the flanges 100, 102. The projections 104 have a curved shape, with the projection 106 having a continuous spiral shape. The projections 104, 106 might be separately formed and attached to the flanges 100, 102.

Figure 10:
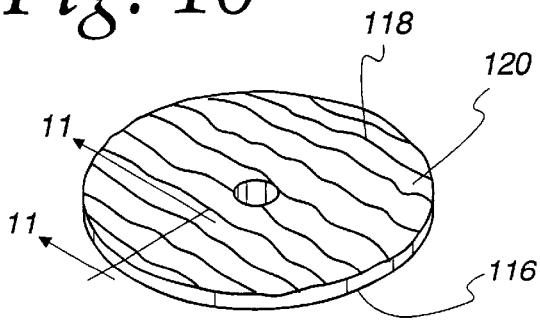
FIG. 10 is a view as in FIG. 9 with a still further form of projection, according to the present invention.
Figure 11:
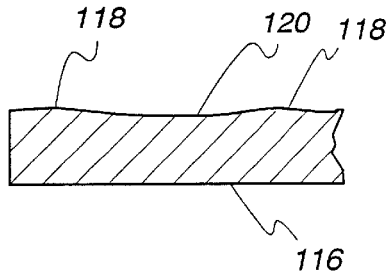
FIG. 11 is a cross-sectional view of the flange taken along line 11—11 of FIG. 10.

In FIGS. 10 and 11, a flange 116 is shown with projections 118 defined on a surface 120 thereof. In this case, the projections are formed by roughening the surface 120 by any means known to those skilled in this art.

Figure 14:
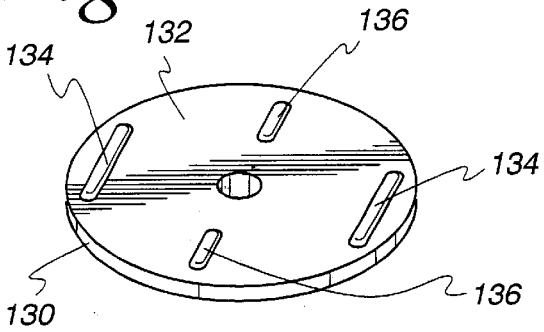
FIG. 14 s a view as in FIG. 12 of a still further modified form of projection, according to the invention.

In FIG. 14, a flange 130 is shown with a surface 132 having another form of projection, including long and short, generally straight, ridge-like projections, 134, 136. As in all embodiments, the projections 134, 136 may be integrally formed, molded in place, or attached as by an adhesive.

Figure 13:
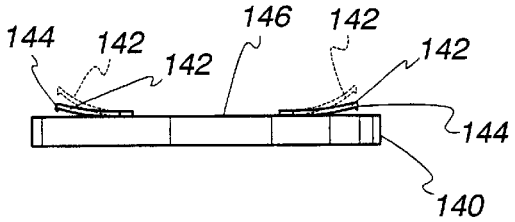
FIG. 13 is a side elevation view of the flange in FIG. 12.
Figure 12:
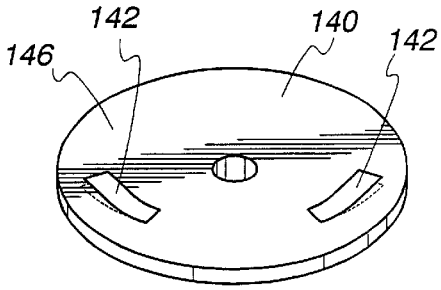
FIG. 12 is a view as in FIG. 10 of a still further modified form of projection, according to the present invention.

In FIGS. 12 and 13, a flange 140 is shown with projections 142 in the form of spring-type elements with offset free ends 144. The free ends 144 are biased upwardly and are urged under a captive force slightly downwardly towards a flange surface 146 from which they project with the bobbin assembly on which the flange 140 is provided operatively connected to a support therefor.

One or both of the projections 142 shown may be made from a shape-retentive material, such as thin metal, which can be placed and maintained in a plurality of different configurations, as shown for example in dotted lines in FIG. 13, to thereby vary the resistive force.

Figure 15:
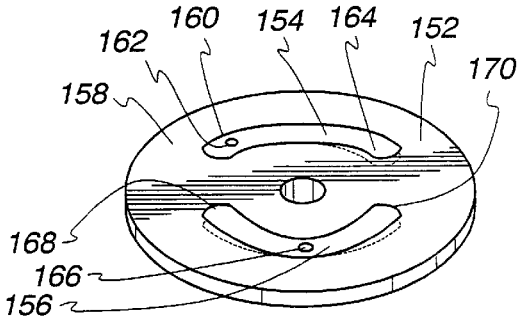
FIG. 15 is a view as in FIG. 14 of a still further modified form of projection, according to the present invention.
Figure 16:
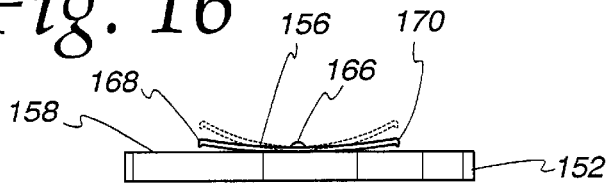
FIG. 16 is a side elevation of the flange of FIG. 15.

In FIGS. 15 and 16, a flange 152 is shown with a pair of projections 154, 156 from a surface 158. The projection 154 has an end 160 secured to the surface 158, as by a fastener 162, and a free end 164 that is bent upwardly, and preferably reconfigurable as the projections 142 in FIGS. 12 and 13.

The projection 156 has a fastener 166 which maintains a central portion thereof attached to the surface 158, and spaced free ends 168, 170, corresponding to those 144 previously described, and projecting upwardly from the surface 158 to be biased against a cooperating support surface. The free ends may be reconfigurable and made from a shape-retentive material that can be reconfigured, or a spring-type material which tends towards a single configuration.

In all the embodiment shown, the bobbin assemblies, according to the present invention, can be operatively connected so that the projections on the flange surfaces thereon abut to a surface on a cooperating support to guide, yet not significantly inhibit, rotation of the bobbin relative to the support. The projections shown are but exemplary of the many different types of projections contemplated by the invention. It is desirable that, regardless of the shape of the projection, the projection(s) occupy an area on its associated flange surface that is less than the area of that flange surface.

The foregoing disclosure of specific embodiments is intended to be illustrative of the broad concepts comprehended by the invention.

What is claimed is:

1. In combination:

a) a bobbin assembly comprising:

i) a core around which a supply of thread can be wrapped, the core having a rotational axis; and ii) a first flange having first and second oppositely facing surfaces, the first surface bounding a storage space for thread wrapped around the core, the first flange comprising at least one elongate, bendable, fiber-like projection having a length, the length of the elongate projection directed axially relative to the rotational axis from the second surface; and b) a support for the bobbin assembly, said support comprising:

i) a third surface facing the second surface and bearing against and bending the at least one projection and limiting movement of the bobbin assembly in a direction substantially parallel to the rotational axis with the bobbin assembly operatively connected to the support, the bobbin assembly rotatable relative to the third surface around the rotational axis of the core to allow paying of thread off the core.

2. The combination according to claim 1 further comprising a supply of thread wrapped around the core.

3. The combination according to claim 1 wherein the first and second surfaces have substantially the same area and the at least one projection occupies an area that is less than the area of the second surface.

4. The combination according to claim 1 wherein the at least one projection is formed as one piece with the first flange.

5. The combination according to claim 1 wherein the at least one projection is formed separately from and fixedly attached to the first flange.

6. The combination according to claim 5 wherein the first flange and at least one projection are made from the same material.

7. The combination according to claim 5 wherein the first flange and the at least one projection are made from different materials.

8. The combination according to claim 1 wherein the bobbin assembly further comprises a second flange that is spaced along the rotational axis from the first flange so that the first and second flanges cooperatively bound the thread storage space.

9. The combination according to claim 1 wherein there are a plurality of projections from the second surface which bear against the third surface with the bobbin assembly operatively connected to the support.

10. The combination according to claim 1 wherein the at least one projection comprises a formed ridge.

11. The combination according to claim 1 wherein the at least one projection is defined by roughening the second surface.

12. The combination according to claim 1 wherein the at least one projection comprises a projecting post.

13. The combination according to claim 1 wherein the at least one projection comprises an element that is embedded in the first flange.

14. The combination according to claim 1 wherein the support comprises a bobbin basket.

15. The combination according to the claim 14 wherein the bobbin basket comprises a post which projects into the core, the bobbin assembly moving around the post as the bobbin assembly moves around the rotational axis.

16. The combination according to claim 1 wherein the support comprises a bobbin case.

17. The combination according to claim 1 wherein the at least one projection is made from a shape-retentive material which can be placed and maintained in a plurality of different configurations.

18. The combination according to claim 1 wherein the at least one flexible projection comprises a plurality of flexible fibers.

19. A bobbin assembly for a supply of thread, said bobbin assembly comprising:

a core around which a supply of thread can be wrapped, the core having a rotational axis; and a first flange having first and second oppositely facing surfaces, the first surface bounding a storage space for thread wrapped around the core, the first flange comprising at least one elongate, flexible, fiber-like projection having a length, the length of the flexible projection directed axially relative to the rotational axis from the second surface.

20. The bobbin assembly for a supply of thread according to claim 19 wherein the first and second surfaces have substantially the same area and the at least one projection occupies an area that is less than the area of the second surface.

21. The bobbin assembly for a supply of thread according to claim 19 wherein the at least one projection comprises a formed ridge.

22. The bobbin assembly for a supply of thread according to claim 19 wherein the at least one projection is defined by roughening the second surface.

23. The bobbin assembly for a supply of thread according to claim 19 wherein the at least one projection comprises a projecting post.

24. The bobbin assembly for a supply of thread according to claim 19 wherein the first flange and the at least one projection are made from different materials.

25. The bobbin assembly for a supply of thread according to claim 19 wherein the at least one projection is repositionable by bending relative to the first flange.

26. The bobbin assembly according to claim 19 wherein the at least one flexible projection comprises a plurality of flexible fibers.

* * * * *